United States Patent [19]

Blank et al.

[11] 4,236,390

[45] Dec. 2, 1980

[54] KNITTING MACHINE

[75] Inventors: Jochen Blank, Pluederhausen; Dieter Bobe, Filderstadt, both of Fed. Rep. of Germany

[73] Assignee: Terrot Strickmaschinen GmbH, Stuttgart, Fed. Rep. of Germany

[21] Appl. No.: 959,073

[22] Filed: Nov. 9, 1978

[51] Int. Cl.[2] ..... D04B 15/88; D04B 35/10

[52] U.S. Cl. ..... 66/149 R; 66/157; 318/6

[58] Field of Search ..... 318/6, 255, 432; 66/149 R, 151, 157, 56

[56] References Cited

U.S. PATENT DOCUMENTS

| | | | |
|---|---|---|---|
| 2,817,220 | 12/1957 | Mahler et al. | 66/56 |
| 2,864,248 | 12/1958 | Wiesinger | 66/56 |
| 3,406,539 | 10/1968 | Wiesinger et al. | 66/56 |
| 3,458,155 | 7/1969 | Planteijdt | 318/6 X |
| 3,777,235 | 12/1973 | Lahti | 318/432 X |
| 3,938,757 | 2/1976 | Sargunar | 318/6 X |
| 3,940,954 | 3/1976 | Romoli | 66/157 |
| 4,020,655 | 5/1977 | Raisin et al. | 66/157 |
| 4,027,506 | 6/1977 | Bitzer | 66/149 R |

FOREIGN PATENT DOCUMENTS

| | | | |
|---|---|---|---|
| 829930 | 1/1952 | Fed. Rep. of Germany . | |
| 2631223 | 1/1978 | Fed. Rep. of Germany | 66/149 R |
| 2260219 | 10/1975 | France | 318/6 |
| 639118 | 6/1950 | United Kingdom . | |
| 1131213 | 10/1968 | United Kingdom | 318/6 |
| 1201930 | 8/1970 | United Kingdom | 318/255 |
| 371656 | 10/1973 | U.S.S.R. | 318/6 |
| 458878 | 3/1975 | U.S.S.R. | 318/6 |

*Primary Examiner*—Wm. Carter Reynolds

*Attorney, Agent, or Firm*—Leydig, Voit, Osann, Mayer & Holt, Ltd.

[57] ABSTRACT

Apparatus for controlling the material tension in a knitting machine, particularly a circular knitting machine, by employing a permanent magnet-excited d.c. motor and an associated circuit to drive a motor torque-dependent material take-off mechanism through the generation of a variable magnitude, pulsed current to power the motor. The magnitude of the current may be set by the operator, with the pulse/no pulse ratio of the current being controlled by the operating mode of the knitting device. In a preferred embodiment, an additional circuit monitors the operation of the current control circuit to detect and signal malfunctions.

8 Claims, 3 Drawing Figures

KNITTING MACHINE

The present invention relates to improvements in a knitting machine comprising a knitting device and a knitted goods take-off mechanism. This general type of knitting machine is disclosed in German utility model 6 928 108. In the case of the known knitting machine, the winding reel on which the knitted material is accumulated also serves as the knitted goods take-off mechanism and comprises a drive motor and associated actuator for adjusting the torque of the drive motor to maintain constant tension in the knitwear.

A drawback of the known knitting machine is that in order to automatically maintain the knitwear, particularly tubular knitwear, under constant tension, at least one relatively sensitive feeler must be provided to sense the mechanical tension in the knitwear and adjust the motor torque with its output signals. It will be apparent that, in addition to transient variations in motor torque required to compensate for tension variations during the course of operation of the knitting device, a steady increase in the motor torque must occur to compensate for the otherwise steady decrease in the knitwear tension due to the increase in the diameter of the winding reel.

The problems encountered with the varying diameter of the winding reel can be avoided if, according to a previous disclosure in U.S. Pat. No. 4,027,506, driven take-off rollers are employed for taking the knitwear, particularly the tubular material, off the knitting devices and if the winding reel itself is driven by the material wound around it.

Despite the difficulties mentioned, it has been found that it is possible for an experienced operator to maintain the correct material tension, even with relatively simple means, over the operating time of the knitting machine. Further difficulties arise, however, both with the known simple auxilliary devices as well as with the sophisticated regulating systems, for example those in accordance with the cited German utility model No. 6 928 108, during start-up and shutdown of the knitting devices and also when the knitting devices operate at "creep" speed, as, for example, when errors in the knitwear must be corrected.

The object of the present invention is to provide a knitting machine having an improved material take-off mechanism in which, in a relatively simple manner, the tension in the knitwear being taken off can be maintained constant within very close limits and, if required, can be varied with the machine in operation.

An additional object is to provide a machine of the above type which maintains constant, reduced tension during the start-up, shutdown and "creep" modes of operation of the knitting device.

A further object is to provide a machine of the above type which employs readily available, relatively low cost, integrated semi-conductor circuits for the control of the improved material take-off mechanism.

Yet another object of the invention is to provide a machine of the above type which may be internally monitored for proper operation.

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention.

The problems in maintaining the proper knitwear material tension throughout the range of operation of a knitting machine of the type initially described above may be overcome according to the invention by utilizing a permanent magnet-excited d.c. drive motor in the knitted goods take-off mechanism with an associated control circuit. The advantage in utilizing a permanent magnet-excited d.c. motor is that the torque of such a motor is proportional to the armature current over a wide range. Since the tension in the material is proportional to the motor torque, it too is proportional to the armature current. As explained in detail below, the control circuit comprises means for controlling the current to the drive motor to, in turn, maintain the proper tension in the knitted material.

Figure 1:
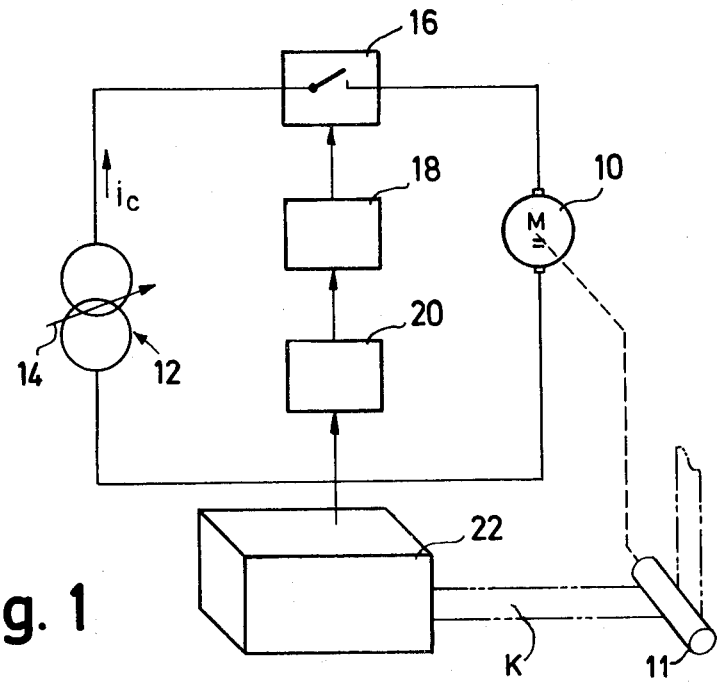
FIG. 1 is a block diagram of a knitting machine take-off motor control circuit of the present invention.

Referring first to FIG. 1, a permanent magnet-excited d.c. drive motor 10 drives the roller 11 which takes off the knitted material K from the knitting device 22 shown in block form in FIG. 1. Drive motor 10 is supplied from a constant current source 12, which supplies a constant, variable—as indicated by the arrow 14—current $i_c$. One pole of the constant current source 12 is connected to one terminal of drive motor 10 (or to its armature winding), via an electronic switch 16. The other terminal of the drive motor (or its armature winding) is connected to the other pole of constant current source 12. According to the invention, a conventional pulse generator 18, in particular an electronic pulse generator, opens and closes electronic switch 16 according to a given pulse duty factor. Providing, preferably, an electronic switch 16 between the constant current source 12 and the drive motor 10, which switch can be switched on and off by a pulse generator 18, ensures the safe starting of the drive motor for the take-off roller 11 with the desired torque. Feeding a non-pulsating direct current directly to the permanent magnet d.c. motor, on the other hand, would require an increased starting current since, during starting, the static friction must be overcome. According to the invention the static friction during starting is overcome with individual current pulses considerably higher than the average current. The pulse duty factor may be selected such that overcoming the static friction does not constitute any problem.

The average current to the drive motor 10 determines the torque applied to the take-off roller 11, and, consequently, the tension in the knitted goods K. This average current is a function of the magnitude of the individual current pulses and the pulse duty factor. Accordingly, varying either the magnitude of the current pulses or the pulse duty factor, or both, varies the output torque and, consequently, the tension of the knitwear. In this regard, switchover subcircuit 20 controls the pulse duty factor of the pulse generator 18 and is in turn controlled by the knitting device 22. With this arrangement, the switching off of the knitting device 22 can be used to trigger a variation in the pulse duty factor of the output of the pule generator 18. In the case of a knitting machine in accordance with the invention tested in practical operation, it was found that halving the pulse duty factor, or doubling the no-pulse times for a given pulse frequency at the output of the pulse generator 18 during shutdown of the knitting device leads to particularly advantageous results. Doubling the no-pulse times as suggeted halves the average value of the current through the armature winding of the motor 10 such that its torque is also reduced to approximately half its previous amount, proportionally reducing the tension in the material to be taken off. This reduced tension is sufficient when operating the knitting devices via the hand drive and, further, avoids follow-up of the drive motor. These results can only be achieved with difficulty in the prior art knitting machines. They are, however, most important, if, for example, the knitting devices must be rotated manually a few revolutions by the operator for the purpose of correcting defects in order to knit one or several courses.

Feeding drive motor 10 with an average current reduced to half its normal level has also proven to be adequate in the case of the tested embodiment to ensure a common and uniform coasting of the drive means for the knitting device and the goods take-off mechanism. It should be understood that with regard to the amount of reduction of the average value of the supply current for the armature winding of the drive motor 10, different optimum values may be found, depending on the type of machine. The specific reduction will have to be determined empirically for each individual case.

Figure 2:
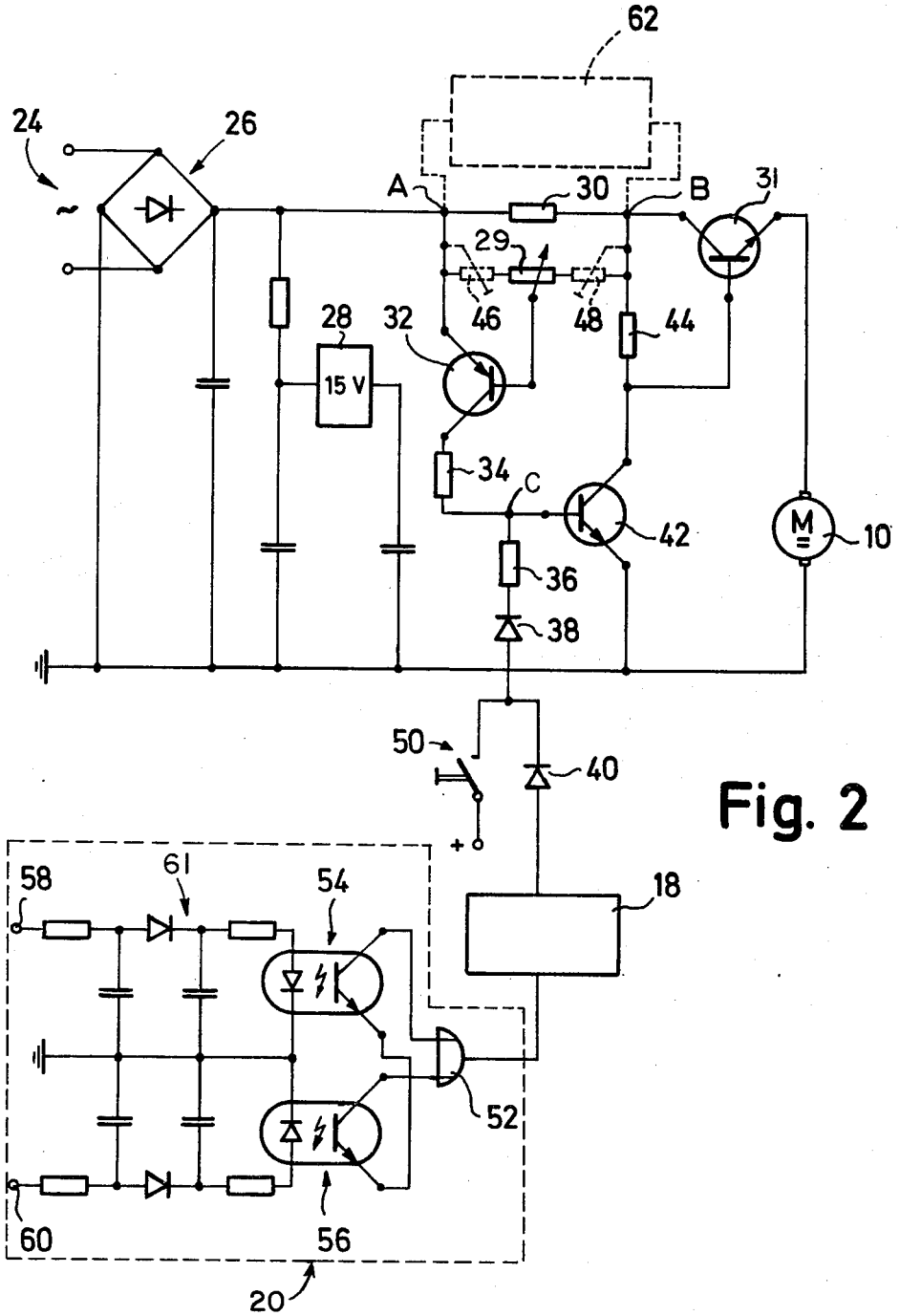
FIG. 2 is a detailed circuit diagram for an embodiment of a take-off motor control circuit of the present invention.

Turning now to FIG. 2, control circuitry for the drive motor 10 of the take-off mechanism of a knitting machine in accordance with the invention tested in practical operation will now be explained in detail. The circuitry shown in FIG. 2 includes an a.c. voltage source 24, which is applied to the inputs of a Gratz rectifier 26. The d.c. output voltage of the Gratz rectifier is fed to a conventional semiconductor circuit 28 to produce a supply voltage of, e.g., 15 Volts, for the various logic circuits, explained in more detail below. The output of the Gratz rectifier 26 flows via a measuring resistor 30 to means for pulsing the output according to the present invention. In the embodiment shown the collector-emitter junction of a transistor 31, forming a switch corresponding to item 16 in FIG. 1, controls the supply of the Gratz rectifier 26 output to one terminal of drive motor 10. The other terminal of the drive motor 10 is connected to the other output of the Gratz rectifier 26 which, in the case of the embodiment shown, is connected to ground. Control of the magnitude of the current pulses to the motor 10 is achieved with potentiometer 29 connected parallel to resistor 30. In a preferred embodiment the potentiometer 29 is a 10-pitch helical potentiometer. The wiper of potentiometer 29 is connected to the base of a transistor 32, the emitter of which is connected to point A, the connection point of the Gratz rectifier 26 and the measuring resistor 30, and the collector of which is connected to the output of pulse generator 18 via series-connected resistors 34 and 36 and diodes 38 and 40. The connection point C of resistors 34 and 36 is connected to the base of a transistor 42, the emitter of which is connected to ground and collector of which is connected to point B, the other end of measuring resistor 30, via a resistor 44. Either or both of trimming resistors 46 and 48 indicated by broken lines, can be connected in series with potentiometer 29. These potentiometers facilitate the setting of maximum and minimum limits on the output current from the Gratz rectifier 26. In this manner it can be ensured that variation of the output current can be effected only over the desired range within which the drive motor torque in actually proportional to the amature current.

In the embodiment shown, there is further provided a manually operated switch 50, which is connected in parallel to diode 40 at the output of pulse generator 18. In addition, an OR circuit 52 comprising part of the switchover subcircuit 20 is connected to the input of pulse generator 18, each of the two inputs of said OR circuit connected to the output of one of the two optocouplers 54 and 56. The inputs of optocouplers 54 and 56 are connected to terminals 58 and 60 via a conventional filter sections indicated at 61. The potential of said terminals 58 and 60 may, for example, be controlled in a known manner to reflect the on or off status of being the main contactor and the creep speed contactor, respectively, of the knitting devices (not shown).

Describing the function of the circuitry illustrated in FIG. 2, when a current flows from the output of the Gratz rectifier 26 to the armature winding of drive motor 10, a voltage drop results across measuring resistor 30. An adjustable portion of this voltage is applied to the base of the transistor 32 by potentiometer 29 (and by trimming resistors 46, 48, if employed). Transistor 32 opens at a predetermined base voltage, in turn causing the transistor 42 to become conductive. The base of the transistor 31 is connected to the collector of transistor 42 such that the former receives an increasingly lower base voltage the more the transistor 42 opens. A reduced current flow through the transistor 31 causes the voltage across measuring resistor 30 to decrease, which again causes the base voltage for transistor 32, and thus the base voltage for transistor 42, to drop. As a result, the voltage at the base of the transistor 31 increases again. The transistor 31 and the two additional transistors 32 and 42 thus form a closed control loop which, in the stabilized condition, ensures a constant current through the armature winding of drive motor 10, with the magnitude of this constant current being determined by the position of potentiometer 29 and essentially independent of the output voltage of Gratz rectifier 26.

From the above explanation, it will be appreciated that in addition to the potentiometer 29, the transistor 31 also forms a part of the constant current source shown schematically as item 12 with variable control 14 in FIG. 1.

Referring again to FIG. 2, switching on and off the direct current through the armature winding of drive motor 10, which, again, is a permanent magnet-excited d.c. motor, is effected by means of pulse generator 18 which, with the selected pulse duty factor, raises the base of transistor 42 via diodes 39 and 40 and resistor 36 to such a high positive potential that said transistor becomes fully conductive and thus blocks the transistor 31. The same positive potential can also be applied to the base of transistor 42 via the manual switch 50 in order to completely interrupt the current flow to drive motor 10 and to switch off the material take-off mechanism.

During the normal operation of the knitting machine, the pulse duty factor at the output of pulse generator 18 remains constant. Furthermore, the position of potentiometer 29 and, thus, the magnitude of the selected constant current, remains unchanged under normal operating condition. A variation in the material tension may become necessary and advantageous in the case of a change in material to be knitted or in the pattern. In such a case the potentiometer 29 may simply be readjusted. Operator readjustment of the potentiometer 29 may be facilitated by calibrating it directly in units of tension acting on the knitwear.

According to a feature of the invention, the pulse duty factor may be changed simultaneously with the shutting off of the knitting device. To effect this change, the shutting off of the knitting device can trigger a potential variation at one of terminals 58 or 60, which reverses the binary output of the OR circuit 52. This output change can then effect a variation of the pulse duty factor in pulse generator 18 by e.g., extending the no-pulse times for a given pulse frequency, preferably to twice in the previous time interval, as discussed above. In the embodiment shown in FIG. 2, "no-pulse times" are those time intervals during which a potential is applied to the output of pulse generator 18, causing transistor 42 to become fully conductive and block the transistor 31.

In practical operation, it has proven to be advantageous to construct the pulse generator 18 from two commercially available mono-stable multi-vibrators connected to form one astable multi-vibrator. Such a pulse generator construction is particularly suited to variation of the pulse duty factor through the output of OR circuit 52 connected to the base of a transistor (not shown) which opens when output of the OR circuit 52 changes at the switching off of the knitting device. This arrangement connects as additional capacitance in parallel to the time-controlling capacitance of the monostable multi-vibrator controlling the no-pulse times.

In a further development of the invention, it has also proven to be advantageous to connect a monitoring circuit in parallel to measuing resistor 30, such a circuit being indicated in FIG. 2 by broken lines as item 62 between circuit points A and B. This circuit monitors the current supply to the drive motor 10 and may include an alarm signal and/or an automatic shutdown of the knitting devices when the reliable functioning of the take-off mechanism is no longer ensured. It is particularly advantageous to signal when the current supplied to the drive motor drops below a given lower limit and, also, to assure that the current supplied to the armature of the drive motor is actually pulsed according to the invention.

Figure 3:
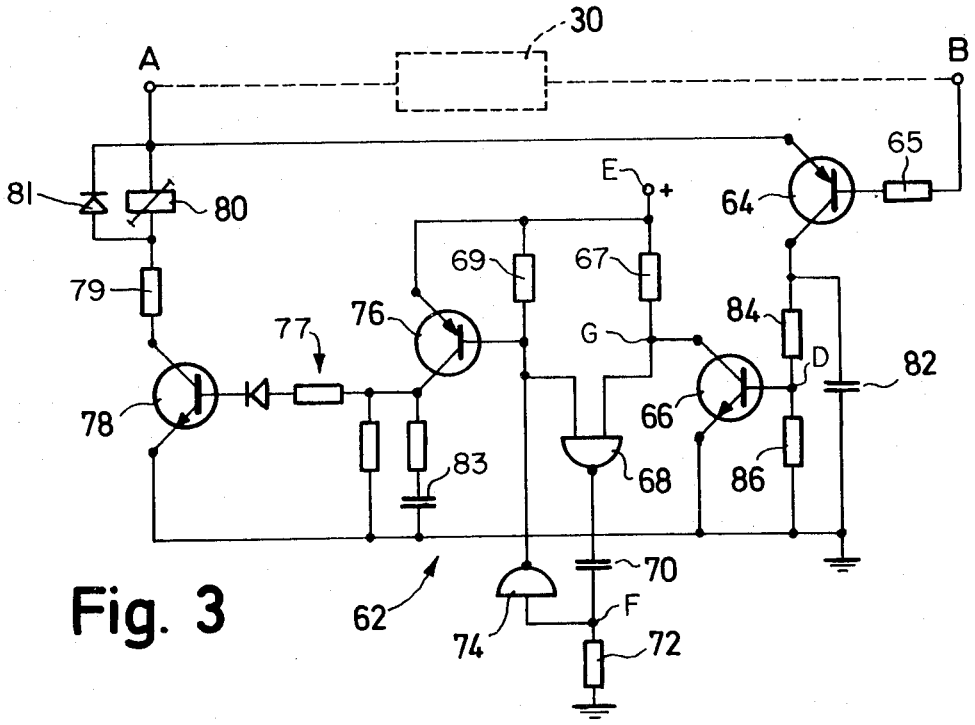
FIG. 3 is a monitoring circuit for the control circuit shown in FIG. 2.

A preferred embodiment of monitoring circuit 62 is shown in FIG. 3 where, for ease of understanding, measuring resistor 30 is indicated by broken lines. As shown in FIG. 3, monitoring circuit 62 comprises a first transistor 64 whose emitter is connected to circuit point A and whose base is connected via a series resistor 65 to circuit point B. First transistor 64 opens when an adequate voltage is applied across measuring resistor 30, i.e., when the current through measuring resistor 30 exceeds a given lower threshold. The collector of first transistor 64 is connected to ground via the series connection of resistors 84 and 86 and, in parallel, via a capacitor 82. The connection point D of the two resistors is connected to the base of second transistor 66 whose emitter is applied to ground and whose collector is applied to a positive potential at point E via a collector resistor 67. Second transistor 66 is opened when first transistor 64 is conductive. The collector of second transistor 66 is connected at point G to one input of NAND circuit 68. The output of NAND circuit 68 is applied to ground via the series connection of a capacitor 70 and a resistor 72. The connection point F of capacitor 70 and resistor 72 is connected to the second input of NAND circuit 68 via an inverter 74. The second input of NAND circuit 68 is further connected to positive the potential at point E via a resistor 69 as well as to the base of a third transistor 76. The emitter of this transistor 76 is also connected to the positive potential at point E. The collector of third transistor 76 is connected via a filter network indicated at 77 to the base of a fourth transistor 78 whose emitter is connected to ground and whose collector is connected via a collector resistor 79 and a relay 80 to circuit point A, with a trip-free diode 81 connected in parallel to relay 80.

Explaining the function of the monitoring circuit 62 shown in FIG. 3, first transistor 64 is controlled to become conductive at each current pulse across measuring resistor 30 which exceeds a given lower threshold. The conductivity of the transistor 64 thereby charges capacitor 82, which discharges during the no-pulse times via the series connection of resistors 84 and 86. Accordingly, a d.c. voltage occurs at the base of second transistor 66 which pulsates with the frequency of the current pulses and which controls the second transistor to become more or less conductive. The resulting voltage fluctuations at point G cause NAND circuit 68 to be alternately fully conductive and blocked via the feedback branch including inverter 74. The third transistor 76 is alternately switched on and off, generating across the capacitor 83 a sufficiently high voltage to permanently maintain fourth transistor 78 in the conductive condition. With transistor 78 conductive, current flows through relay 80, indicating that the circuitry is functioning satisfactorily. If, however, the current flow across measuring resistor 30 is so small that first transistor 64 does not become more or less conductive, relay 80 drops off to indicate a malfunction. If required, the drive motor 10 for the take-off mechanism and the knitting device can be shut off by relay 80 in this case. Monitoring circuit 62 also functions to indicate when the current across measuring resistor 30 is of sufficient magnitude but not pulsating. In this case, NAND circuit 68 remains blocked, which again results in a drop off of relay 80.

We claim:

1. Apparatus for controlling the material tension in a knitting machine, particularly a circular knitting machine, having a knitting device with at least two operating modes, and means to take off the knitted material under tension, the apparatus comprising:

a d.c. motor to drive the material take-off means, the torque of the motor being proportional to the average motor armature current and effecting a proportional tension in the material through the material take-off means;

first means for generating a direct current of controlled magnitude;

second means for interrupting the controlled-magnitude direct current according to one at least two predetermined pulse duty factors to produce a pulsed current yielding a different average current for each of the two pulse duty factors;

third means for applying the pulsed current to the d.c. motor as the motor armature current to effect a different constant tension in the material for each different pulsed current; and fourth means responsive to each of at least two of the operating modes of the knitting device for controlling the second means to interrupt the controlled-magnitude current according to a predetermined one of the pulse duty factors for each of the two operating modes, whereby the the material is maintained at a different predetermined constant tension for each of the two operating modes of the knitting device.

2. The apparatus of claim 1, the first means comprising a current source, a closed control loop having an output of a controlled-magnitude current and fifth means for selectively varying the magnitude of the closed control loop output current.

3. The apparatus of claim 2, the fifth means comprising a multi-pitch helical potentiometer, the potentiometer linearly controlling the magnitude of the direct current generated by the first means, and, as a result, linearly controlling the tension in the material.

4. The apparatus of claim 3, the first means further comprising at least one trimming resistor in series with the potentiometer.

5. The apparatus of claim 1, the operating modes of the knitting device to which the fourth means is responsive comprising on and off.

6. The apparatus of claim 5, the creep operating mode of the knitting device also being one to which the fourth means is responsive.

7. The apparatus of claim 1, further comprising monitoring means responsive to the dropping of the magnitude of the pulse motor armature current below a predetermined lower limit and the absence of pulses in said current.

8. The apparatus of claim 1, the d.c. motor being permanent magnet-excited.

* * * * *

UNITED STATES PATENT AND TRADEMARK OFFICE

CERTIFICATE OF CORRECTION

PATENT NO. : 4,236,390

DATED : December 2, 1980

INVENTOR(S) : Jochen Blank & Dieter Bobe

It is certified that error appears in the above—identified patent and that said Letters Patent is hereby corrected as shown below:

Column 1, line 39, delete "auxilliary" and substitute --auxiliary--;

Column 3, line 1, delete "pule" and substitute --pulse--;

Column 3, line 8, delete "suggeted" and substitute --suggested--;

Column 4, line 5, delete "in" and substitute --is--;

Column 4, line 13, after "circuit" substitute --being--;

Column 4, line 19, delete "being";

Column 4, line 55, delete "39" and substitute --38--;

UNITED STATES PATENT AND TRADEMARK OFFICE

CERTIFICATE OF CORRECTION

PATENT NO. : 4,236,390

DATED : December 2, 1980

INVENTOR(S) : Jochen Blank & Dieter Bobe

It is certified that error appears in the above—identified patent and that said Letters Patent is hereby corrected as shown below:

Column 5, line 14, after "by" insert a comma;

Column 5, line 31, delete "as" and substitute --an--;

Column 5, line 36, delete "measuing" and insert --measuring--;

Column 6, line 58, after "one" insert --of--.

Signed and Sealed this

*Fifth* Day of *May 1981*

[SEAL]

*Attest:*

RENE D. TEGTMEYER

*Attesting Officer* *Acting Commissioner of Patents and Trademarks*